US007312398B2

(12) United States Patent
Suekuni

(10) Patent No.: US 7,312,398 B2
(45) Date of Patent: Dec. 25, 2007

(54) FLEXIBLE FLAT CABLE, METHOD AND APPARATUS FOR ASSEMBLING THE SAME

(75) Inventor: Masato Suekuni, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 11/534,467

(22) Filed: Sep. 22, 2006

(65) Prior Publication Data

US 2007/0068698 A1 Mar. 29, 2007

(30) Foreign Application Priority Data

Sep. 26, 2005 (JP) ..... 2005-007863

(51) Int. Cl.
*H01B 7/08* (2006.01)

(52) U.S. Cl. ..... 174/117 F; 174/117 FF

(58) Field of Classification Search ..... 174/117 F, 174/117 FF; 439/496

See application file for complete search history.

(56) References Cited

U.S. PATENT DOCUMENTS 4,379,361 A * 4/1983 Webster et al. ..... 29/857
5,834,701 A * 11/1998 Saka et al. ..... 174/117 F
6,927,343 B2 * 8/2005 Watanabe et al. ..... 174/254
7,205,482 B2 * 4/2007 Naito et al. ..... 174/254
2003/0056972 A1 * 3/2003 Adams et al. ..... 174/117 F

FOREIGN PATENT DOCUMENTS

JP H03-033982 U 9/2006

* cited by examiner

*Primary Examiner*—Chau N. Nguyen
(74) *Attorney, Agent, or Firm*—The Rafferty Patent Law Firm

(57) ABSTRACT

A flexible flat cable and an apparatus for assembling the flexible flat cable are provided. The flexible flat cable has a conductive wire group including conductive wires disposed parallel to each other and arranged in a synthetic resin cover, in which both end portions and of the conductive wire group protrude outward from the end edges of the cover, and a pair of synthetic resin reinforcing plates are fixed to areas extending from one surface at the respective end portions of the cover through one surface at the respective end portions of the conductive wire group. One of the reinforcing plates includes a hollow square reinforcing plate formed by providing a through hole at the center of a reinforcing plate, and the other reinforcing plate includes a central reinforcing plate extracted from the hollow square reinforcing plate.

7 Claims, 9 Drawing Sheets

FIG.9(a) *(PRIOR ART)*
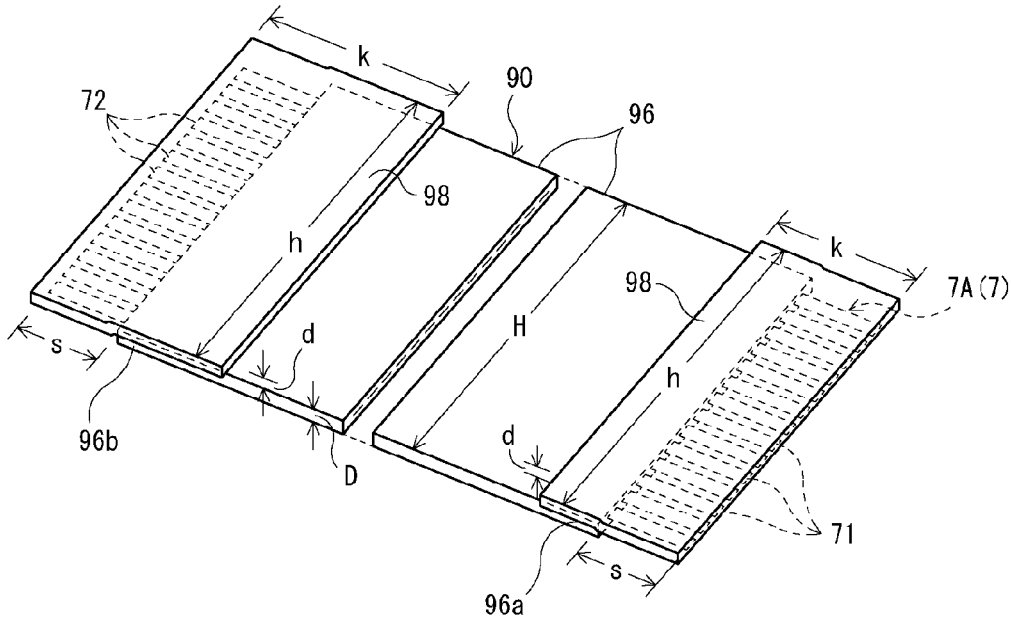
FIG.9(b) *(PRIOR ART)*
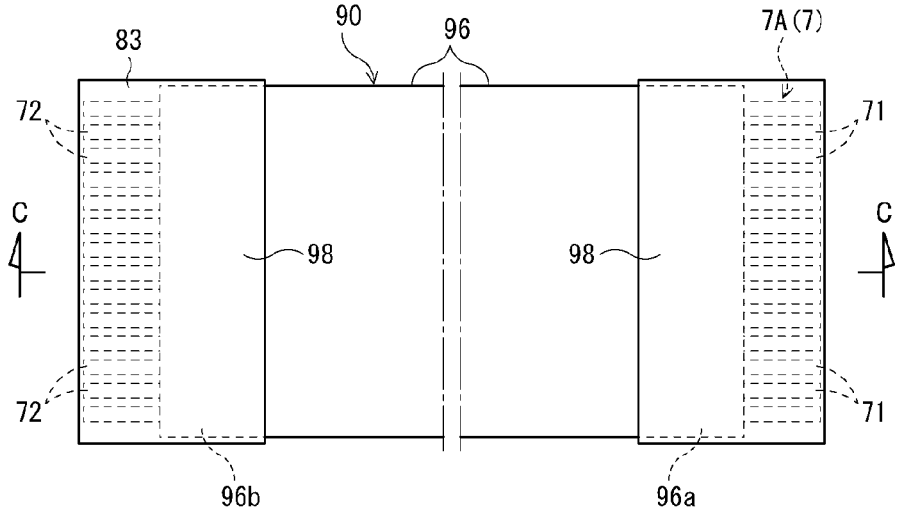
FIG.9(c) *(PRIOR ART)*
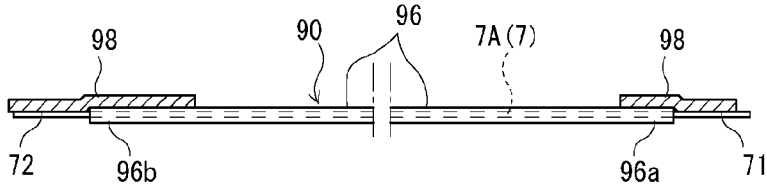

FLEXIBLE FLAT CABLE, METHOD AND APPARATUS FOR ASSEMBLING THE SAME

BACKGROUND

1. Field of the Disclosure

The present disclosure relates to a flexible flat cable such as used in, for example, a disk apparatus (e.g., a DVD player or DVD recorder) and a method and an apparatus for assembling the flexible flat cable.

FIGS. 8(*a*) through 8(*c*) show one non-limiting example of a disk apparatus, in which a main circuit board 3 is arranged on one side of a disk player main body 2 in a chassis 1 and an AV circuit board 4 is arranged below the main circuit board 3, the circuit boards 3 and 4 being connected via connectors 5 and a flexible flat cable FFC, in which the tray 2*a* of the disk player main body 2 is moved in the forward direction "a" based on an unloading signal and a disk D is placed on the tray 2*a*, and then the tray 2*a* is moved in the backward direction "b" based on a loading signal to perform recording, reproduction, or erasing for the disk D.

2. Related Art

There has conventionally been proposed a flexible flat cable technique such as described in Japanese Utility Model Laid-Open Publication No. Hei 3-33982. As shown in FIGS. 9(*a*), 9(*b*) and 9(*c*), for example, a conductive wire group 7 including many conductive wires 7A parallel to each other is arranged in a synthetic resin cover 96 having, for example, a lateral width H of 29 mm and a thickness D of 0.35 mm, and in which both end portions 71 and 72 of the conductive wire group 7 protrude outward from the end edges of the cover 96 by a predetermined protruding length "s" (e.g. 4 mm). Then, two synthetic resin reinforcing plates 98 are fixed by adhesive or fusion bonding from one surface at the respective end portions 96*a* and 96*b* of the cover 96 through one surface at the respective end portions 71 and 72 of the conductive wire group 7, where the end portions 71 and 72 of the conductive wire group 7 accompanied with the respective reinforcing plates 98 are to be inserted into the connectors 5 (refer to FIGS. 9(*a*), 9(*b*) and 9(*c*), for example).

The reinforcing plates 98 are each formed in a rectangular plate shape by setting the lateral width "h" thereof to be approximately the same as the lateral width H of the cover 96 (e.g., 29 mm) and the thickness "d" to 0.35 mm, while setting the longitudinal width "k" thereof to be, for example, 10 mm greater than the protruding length "s" of the end portions 71 and 72 of the conductive wire group 7.

In the above-described conventional arrangement, two reinforcing plates 98 are fixed to the respective end portions 71 and 72 of the conductive wire group 7 so that the end portions 71 and 72 of the conductive wire group 7 are not bent when inserted into the connectors 5, and the reinforcing plates 98 each have a relatively large size and thickness, resulting in an increase in material cost.

SUMMARY

In consideration of the above-described conventional disadvantages, presently disclosed is a flexible flat cable and an apparatus for assembling the same at a reduced material cost.

In view thereof, a first aspect relates to a flexible flat cable, having: a conductive wire group including one or more conductive wires arranged parallel to each other; a cover including a synthetic resin and disposed on the conductive wire group, first and second end portions of the conductive wire group protruding outward from respective end edges of the cover, the first and second end portions of the conductive wire group being adapted to be inserted into connectors; a hollow square reinforcing plate having a through hole disposed generally centrally in the hollow square reinforcing plate, the through hole formed by extracting a central reinforcing plate from the reinforcing plate, the central reinforcing plate being fixed to a vicinity of a leading end of the first end portion of the conductive wire group and to a first end portion of the cover, a front edge portion of the hollow square reinforcing plate being fixed to a leading end of the second end portion of the conductive wire group, a rear edge portion of the hollow square reinforcing plate being fixed to a second end portion of the cover, and both a left and a right side edge portions of the hollow square reinforcing plate integrally joining the front and rear edge portions of the hollow square reinforcing plate fixed to a respective left or right side edge of the second end portion of the conductive wire group and to the second end portion of the cover, in which one or more concavo-convex anti-slip portions are formed on a surface of the central reinforcing plate and on a surface of the hollow square reinforcing plate.

A second aspect relates to a flexible flat cable, having: a conductive wire group including one or more conductive wires arranged parallel to each other; a cover including a synthetic resin and disposed on the conductive wire group, first and second end portions of the conductive wire group protruding outward from respective end edges of the cover, the first and second end portions of the conductive wire group being adapted to be inserted into connectors; a hollow square reinforcing plate having a through hole disposed generally centrally in the hollow square reinforcing plate, the through hole formed by extracting a central reinforcing plate from the reinforcing plate, the central reinforcing plate being fixed to a vicinity of a leading end of the first end portion of the conductive wire group and to a first end portion of the cover, a front edge portion of the hollow square reinforcing plate being fixed to a leading end of the second end portion of the conductive wire group, a rear edge portion of the hollow square reinforcing plate being fixed to a second end portion of the cover, and both a left and a right side edge portions of the hollow square reinforcing plate integrally joining the front and rear edge portions of the hollow square reinforcing plate fixed to a respective left or right side edge of the second end portion of the conductive wire group and to the second end portion of the cover, in which an outer peripheral edge of the central reinforcing plate and an inner peripheral edge of the through hole in the hollow square reinforcing plate are each formed in a zigzag shape, and one or more recessed portions are formed in a surface of the central reinforcing plate and in a surface of the hollow square reinforcing plate so that one or more grid reinforcing frames are disposed between the recessed portions.

A third aspect relates to a flexible flat cable, having: a conductive wire group including one or more conductive wires arranged parallel to each other; a cover including a synthetic resin and disposed on the conductive wire group, first and second end portions of the conductive wire group protruding outward from first and second end edges of the cover; and first and second synthetic resin reinforcing plates fixed to surfaces at first and second end portions of the cover and to surfaces at the first and second end portions of the conductive wire group, the first and second end portions of the conductive wire group fixed to the first and second reinforcing plates each being adapted to be inserted into connectors, in which the first reinforcing plate is a hollow square reinforcing plate having a through hole disposed within the hollow square reinforcing plate and the second reinforcing plate is a central reinforcing plate extracted from the first reinforcing plate.

In a fourth aspect, the third aspect is arranged in such a manner that the central reinforcing plate is fixed to a vicinity of a leading end of the first end portion of the conductive wire group and to the first end portion of the cover, a front edge portion of the hollow square reinforcing plate is fixed to a leading end of the second end portion of the conductive wire group, a rear edge portion of the hollow square reinforcing plate is fixed to the second end portion of the cover, and both a left and a right side edge portions of the hollow square reinforcing plate integrally conjoin the front and rear edge portions of the hollow square reinforcing plate, respectively, and are respectively fixed to a left and a right side edges of the second end portion of the conductive wire group and also to the second end portion of the cover.

In a fifth aspect, the third or fourth aspect is arranged in such a manner that an outer peripheral edge of the central reinforcing plate and an inner peripheral edge of the through hole in the hollow square reinforcing plate are each formed in a zigzag shape.

In a sixth aspect, any of the third to fifth aspects is arranged in such a manner that one or more concavo-convex anti-slip portions are formed in a surface of the central reinforcing plate and in a surface of the hollow square reinforcing plate.

In a seventh aspect, any of the third to fifth aspects is arranged in such a manner that one or more recessed portions are formed in a surface of the central reinforcing plate and in a surface of the hollow square reinforcing plate, and grid reinforcing frames are disposed between the recessed portions.

An eighth aspect relates to an apparatus for assembling a flexible flat cable having a cover including synthetic resin disposed on a conductive wire group having one or more conductive wires arranged parallel to each other, a hollow square reinforcing plate as a first synthetic resin reinforcing plate and a central reinforcing plate as a second synthetic resin reinforcing plate, the apparatus having: a first stamp having a first planar member and movable generally orthogonally to a reinforcing tape; a first cutting portion protruding from the first planar member by a thickness of the central reinforcing plate, the first stamp for pressing the reinforcing tape against a first end portion of the cover and a first end portion of the conductive wire group protruding outward from a first end edge of the cover, the first cutting portion extract the central reinforcing plate from the reinforcing tape and form a through hole in the reinforcing tape; a second stamp having a second planar member and movable generally orthogonally to the reinforcing tape; and a second cutting portion protruding from the second planar member by a thickness of the hollow square reinforcing plate and having a shape which surrounds the through hole, the second stamp for pressing the reinforcing tape against a second end portion of the cover and a second end portion of the conductive wire group protruding outward from a second end edge of the cover, the second cutting portion for extracting the hollow square reinforcing plate from the reinforcing tape, the hollow square reinforcing plate including the through hole within the hollow square reinforcing plate, the first and second end portions of the conductive wire group fixed to the first and second synthetic resin reinforcing plates each being adapted to be inserted into connectors.

In addition, a further aspect may correspond to the method described above, while also relating to: fixing a front edge portion of the hollow square reinforcing plate to a leading edge of the second end portion of the group of conductive wires; fixing a rear edge portion of the hollow square reinforcing plate to the second end portion of the cover; fixing a left side edge portion of the hollow square reinforcing plate conjoining the front and rear edge portions of the hollow square reinforcing plate to the leading edge of the second edge portion of the group of conductive wires and to the second end portion of the cover; and fixing a right side edge portion of the hollow square reinforcing plate conjoining the front and rear edge portion of the hollow square reinforcing plate to the leading edge of the second edge portion of the group of conductive wires and to the second end portion of the cover.

With respect to still another aspect, any of the methods described above may additionally relate to: forming a zigzag shape on an outer peripheral edge of the central reinforcing plate and on an inner peripheral edge of the through hole within the hollow square reinforcing plate; forming one or more concavo-convex anti-slip portions on a surface of the hollow square reinforcing plate and on a surface of the central reinforcing plate; and/or forming one or more recessed portions on a surface of the central reinforcing plate and on a surface of the hollow square reinforcing plate, and forming one or more grid reinforcing frames between the recessed portions.

In accordance with at least the first aspect, as illustrated in FIGS. 1(*a*) to 4(*d*) and 7(*a*), for example, it is possible to significantly reduce material cost because the end portions of the conductive wire group are reinforced by the hollow square reinforcing plate (formed by providing a through hole at the center of a reinforcing plate) and the central reinforcing plate extracted from the reinforcing plate, in which the combination of both the central reinforcing plate and hollow square reinforcing plate together corresponds to an amount of material required for just one conventional reinforcing plate.

In addition, since the central reinforcing plate reinforces one end portion of the conductive wire group from the vicinity of the leading end through the base thereof, while the hollow square reinforcing plate also reinforces the other end portion of the conductive wire group from the leading end through the base thereof, thus the end portions of the conductive wire group can be inserted straight into connectors and function reliably as conductors, without being bent.

Further, it is possible to more reliably prevent fingers from slipping when performing the insertion operation because the concavo-convex slip-resistant portions formed in the surfaces of the central reinforcing plate and the hollow square reinforcing plate can be gripped securely between the fingers while inserting the end portions of the conductive wire group into connectors.

In accordance with at least the second aspect, referring to FIGS. 5, 6, and 7(*b*), for example, it is possible to achieve generally similar effects as in the first aspect, inter alia; and in addition, since the zigzag-shaped outer peripheral edge of the central reinforcing plate and the zigzag-shaped inner peripheral edge of the hollow square reinforcing plate can be securely gripped by the fingers in order to insert the end portions of the conductive wire group into connectors, it is possible to reliably prevent the fingers from slipping when performing the insertion operation.

Also, since many recessed portions may be formed on the surfaces of the central reinforcing plate and the hollow square reinforcing plate at predetermined spacing, and as a result reduce the thickness thereof, it is possible to further reduce material cost. In addition, since grid reinforcing frames may be left between the recessed portions, the end portions of the conductive wire group can be reinforced reliably with no reduction in strength and the grid reinforcing frames can more reliably enhance the anti-slip feature.

In accordance with a preferred embodiment, such as illustrated above by way of example in the third aspect, it is possible to significantly reduce materials costs since the end portions of the conductive wire group may be reinforced by the hollow square reinforcing plate (formed by providing a through hole at the center of a reinforcing plate) and the central reinforcing plate extracted from the hollow square reinforcing plate, in which the combination of both the central reinforcing plate and hollow square reinforcing plate together corresponds to a comparable amount of material required for just one conventional reinforcing plate, it is possible to reduce material cost significantly.

In accordance with at least the fourth aspect, since the central reinforcing plate reinforces one end portion of the conductive wire group from the vicinity of the leading end through the base thereof, while the hollow square reinforcing plate also reinforces the other end portion of the conductive wire group from the leading end through the base thereof, thus the end portions of the conductive wire group can be inserted straight into connectors and function reliably as conductors, without risk of bending.

In accordance with at least the fifth aspect, since the zigzag-shaped outer peripheral edge of the central reinforcing plate and the zigzag-shaped inner peripheral edge of the hollow square reinforcing plate can be securely gripped between the fingers in order to insert the end portions of the conductive wire group into connectors, it is possible to prevent fingers from slipping when performing the insertion operation.

In accordance with at least the sixth aspect, since the concavo-convex anti-slip portions formed in the surfaces of the central reinforcing plate and the hollow square reinforcing plate can be securely grasped by the fingers when inserting the end portions of the conductive wire group into connectors, it is possible to prevent the fingers from slipping and to perform the insertion operation more reliably.

In accordance with at least the seventh aspect, since many recessed portions may be formed in the surfaces of the central reinforcing plate and the hollow square reinforcing plate at predetermined spacing, reducing the thickness thereof, it is possible to further reduce material cost. In addition, since grid reinforcing frames are left between the recessed portions, the end portions of the conductive wire group can thus be reinforced reliably with no reduction in strength and the grid reinforcing frames can additionally enhance the slip-resistance of the central reinforcing plate and the hollow square reinforcing plate.

In accordance with at least one example, as illustrated with regard to the eighth aspect, inter alia, the central reinforcing plate may be extracted from the reinforcing tape and fixed to one end portion of the conductive wire group in a first step, and then the reinforcing tape may be reused to extract the hollow square reinforcing plate to be fixed to the other end portion of the conductive wire group in a second step after the central reinforcing plate has been extracted from the reinforcing tape. Accordingly, many flexible flat cables can be assembled continuously and efficiently, and it is possible to significantly reduce materials costs because the central reinforcing plate and the hollow square reinforcing plate are both extracted from the same section of reinforcing tape.

BRIEF DESCRIPTION OF THE DRAWINGS

FIG. 9(*a*) is a perspective view of two longitudinally opposite end portions of a conventional flexible flat cable, FIG. 9(*b*) is a plan view thereof, and FIG. 9(*c*) is a profile view thereof in the direction of the arrow C-C.

DESCRIPTION OF THE PREFERRED EMBODIMENTS

Figure 1A:
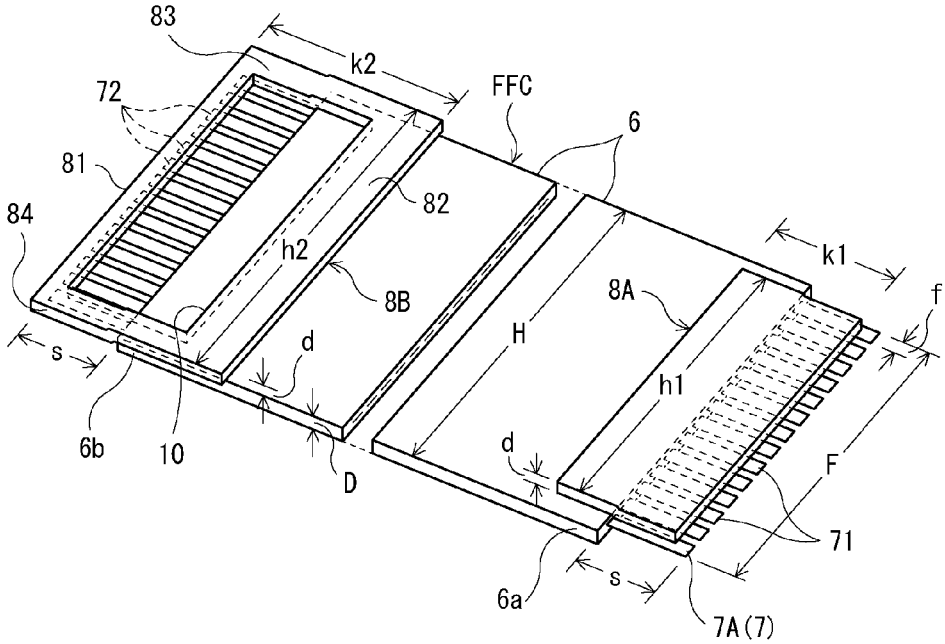
FIG. 1(*a*) is a perspective view of a flexible flat cable according to a first embodiment, FIG. 1(*b*) is a plan view thereof, and FIG. 1(*c*) is a profile view thereof in the direction of the arrow A-A.
Figure 1B:
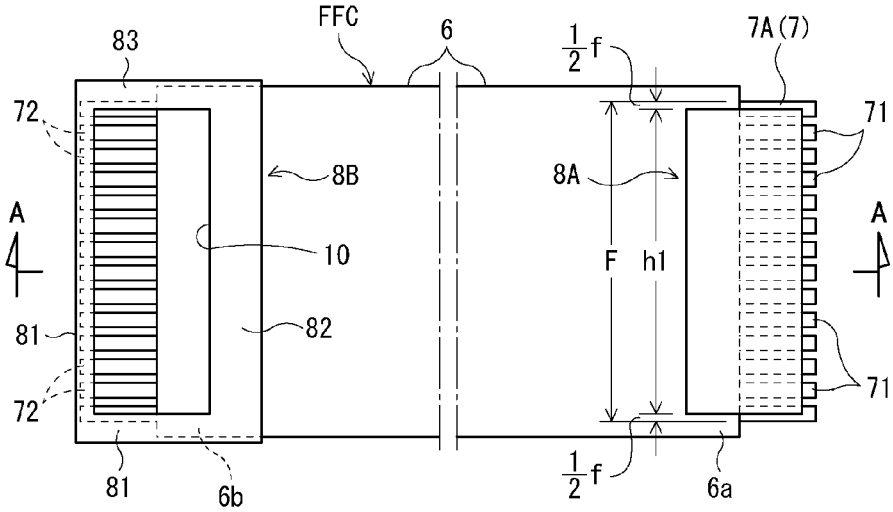
Figure 1C:
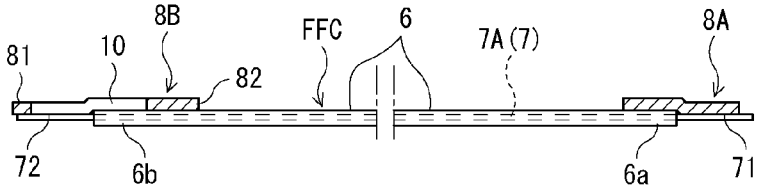
Figure 2:
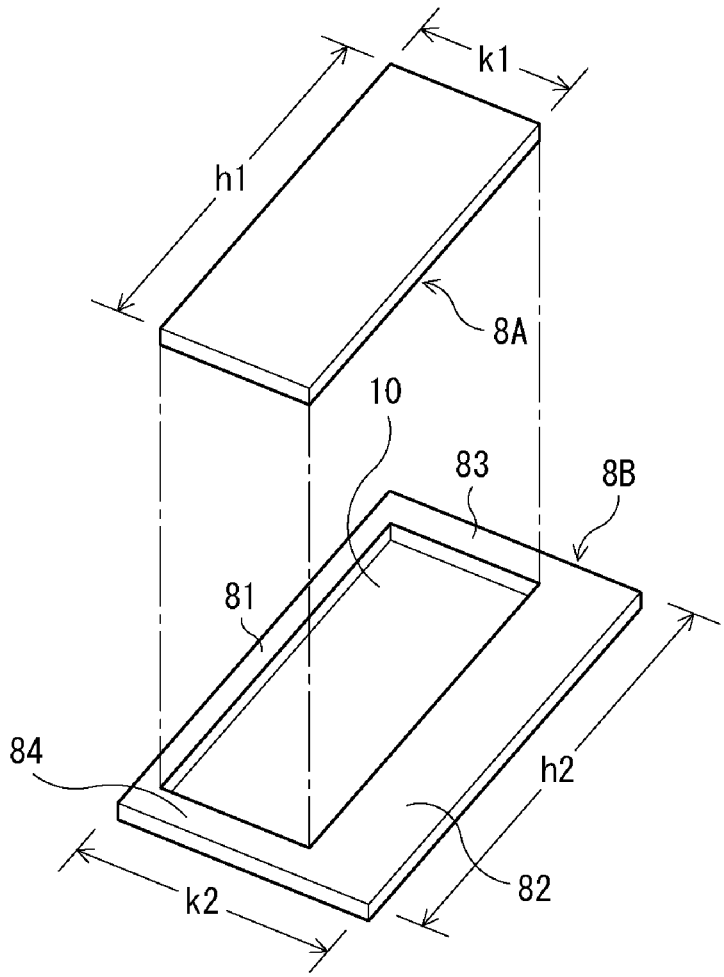
FIG. 2 is a disassembled perspective view of a reinforcing plate.

FIGS. 1(*a*), 1(*b*), 1(*c*) and 2 show a flexible flat cable FFC according to a first embodiment, in which a hollow square reinforcing plate 8B formed by providing a through hole 10 at the center of a reinforcing plate and a central reinforcing plate 8A extracted from the reinforcing plate are used, the reinforcing plates 8A and 8B being fixed on an area extending from one surface at the respective end portions 6*a* and 6*b* of a cover 6 through one surface at the respective end portions 71 and 72 of a conductive wire group 7.

The central reinforcing plate 8A may be made of the same material as conventional reinforcing plates 98 (see FIGS. 9(*a*) through 9(*c*), for example), and the lateral width h1 of the central reinforcing plate may be set to a length obtained by subtracting the lateral width "f" of one conductive wire 7A from the lateral width F of the end portions 71 and 72 of the conductive wire group 7 (such that h1=F−f), while the longitudinal width k1 of the central reinforcing plate may be set to be greater than the protruding length "s" of the end portions 71 and 72 of the conductive wire group 7 extending outward beyond the cover 6. The central reinforcing plate 8A is fixed by, as non-limiting examples, adhesive or fusion bonding (and/or any other suitable fixing technology) onto an area extending from the vicinity of the leading end of the conductive wires (7A, for example) at one end portion 71 of the conductive wire group 7 through the end portion 6*a* of the cover 6 (refer to FIG. 1(*b*)).

As one dimensional example, the lateral width F of the end portions 71 and 72 of the conductive wire group 7 may be 28 mm, the lateral width "f" of one conductive wire 7A may be 0.8 mm, the lateral width h1 of the central reinforcing plate 8A may therefore be (28−0.8)=27.2 mm, the longitudinal width k1 thereof may be 6 mm, and the thickness thereof "d" may be 0.35 mm.

The lateral width h2 and longitudinal width k2 of the hollow square reinforcing plate 8B may be approximately the same, respectively, as the lateral width "h" and longitudinal width "k" of conventional reinforcing plates 98 (refer to FIGS. 9(*a*) through 9(*c*), for example), the front edge portion 81 of the hollow square reinforcing plate 8B being fixed to the leading end of the corresponding end portion 72 of the conductive wire group 7, while the rear edge portion 82 of the hollow square reinforcing plate 8B is fixed to the end portion 6*b* of the cover 6. Both the left and right side edge portions 83 and 84 of the hollow square reinforcing plate 8B may integrally conjoin the front and rear edge portions 81 and 82 fixed from the both side edges of the corresponding end portion 72 of the conductive wire group 7 and extending through the end portion 6*b* of the cover 6.

As one possible specific dimensional example, the lateral width h2 of the hollow square reinforcing plate 8B may be 29 mm and the longitudinal width k2 thereof may be 10 mm.

In accordance with the arrangement above, since the end portion 71 of the conductive wire group 7 is reinforced by the hollow square reinforcing plate 8B that is formed by providing a through hole 10 at the center of a reinforcing plate, and the end portion 7*b* of the conductive wire group 7 is reinforced by the central reinforcing plate 8A extracted from the same section of material used to form the hollow square reinforcing plate, it is possible to significantly reduce materials costs since the combination of both the central reinforcing plate 8A and hollow square reinforcing plate 8B is formed from an amount of material corresponding to just one of the conventional reinforcing plates 98 (e.g., as shown in FIGS. 9(*a*) through 9(*c*)).

Figure 8A:
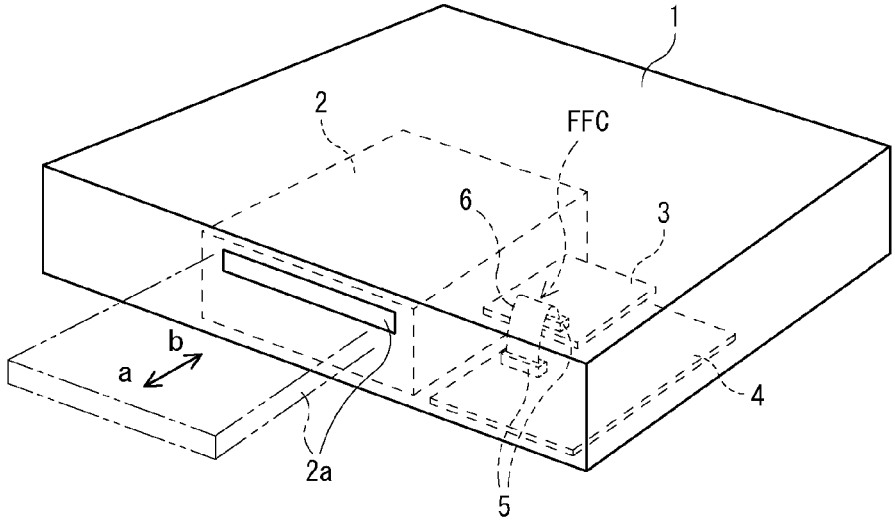
FIG. 8(*a*) is a perspective view of a disk apparatus, FIG. 8(*b*) is a profile detail view of a portion of the disk apparatus, and FIG. 8(*c*) is a detail view of an end portion of a cable of the disk apparatus.
Figure 8B:
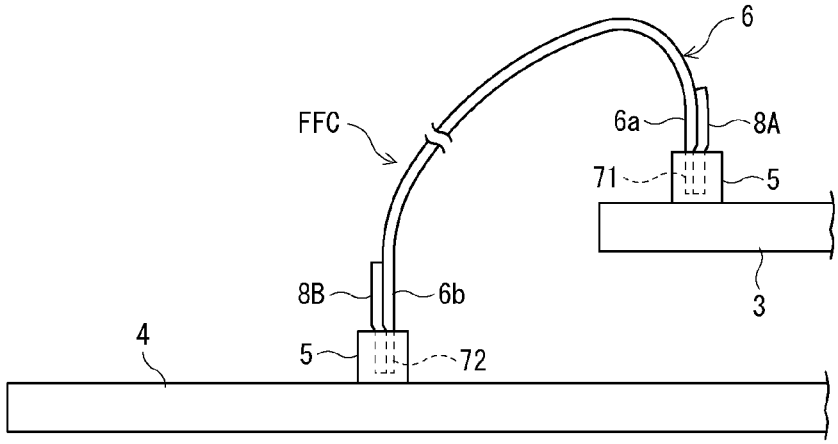
Figure 8C:
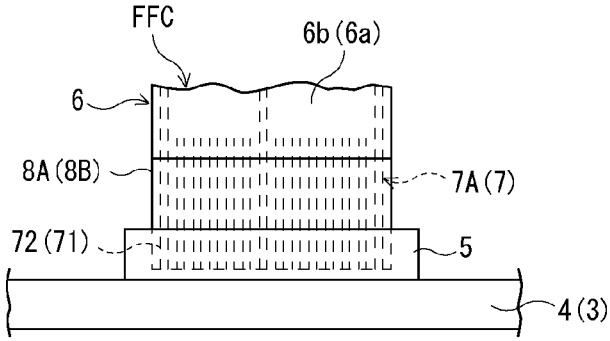

In addition, since the central reinforcing plate 8A reinforces one end portion 71 of the conductive wire group 7 from the vicinity of the leading end through the base thereof, and also the hollow square reinforcing plate 8B reinforces the other end portion 72 of the conductive wire group 7 from the leading end through the base thereof, thus the end portions 71 and 72 of the conductive wire group 7 can be inserted straight into connectors 5 without bending in order to reliably achieve a conductive connection (refer to FIG. 8).

Figure 3A:
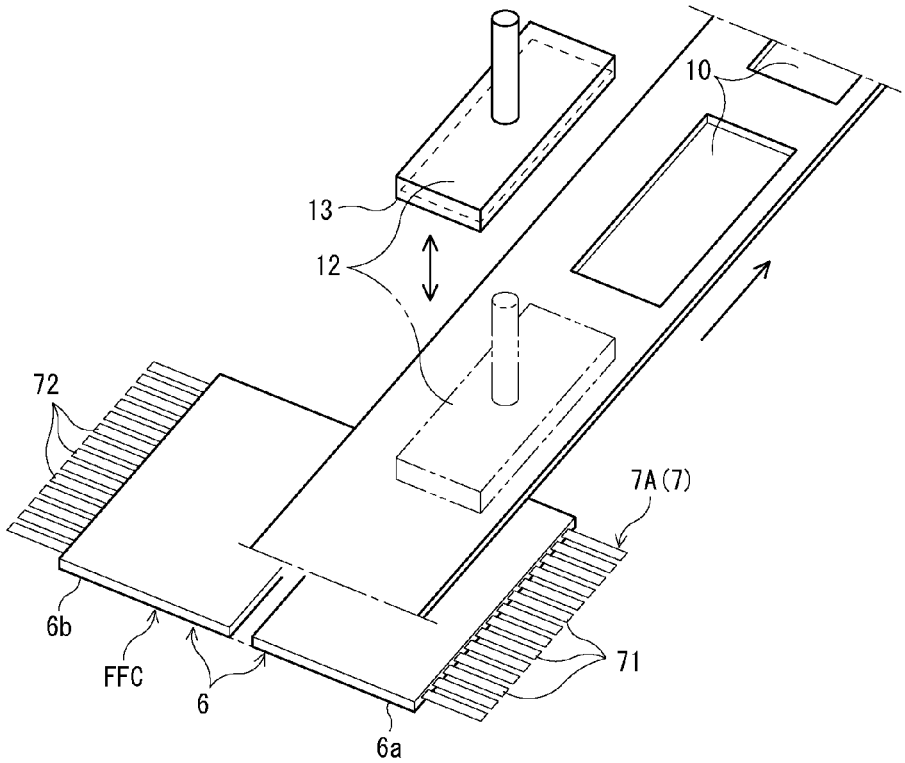
FIG. 3(*a*) is a perspective view of a first step in an assembling procedure, FIG. 3(*b*) is a profile cross-sectional view showing a previous stage of the first step, FIG. 3(*c*) is a profile cross-sectional view showing a middle stage of the first step, and FIG. 3(*d*) is a profile cross-sectional view showing a latter stage of the first step.
Figures 3B, 3C, 3D:
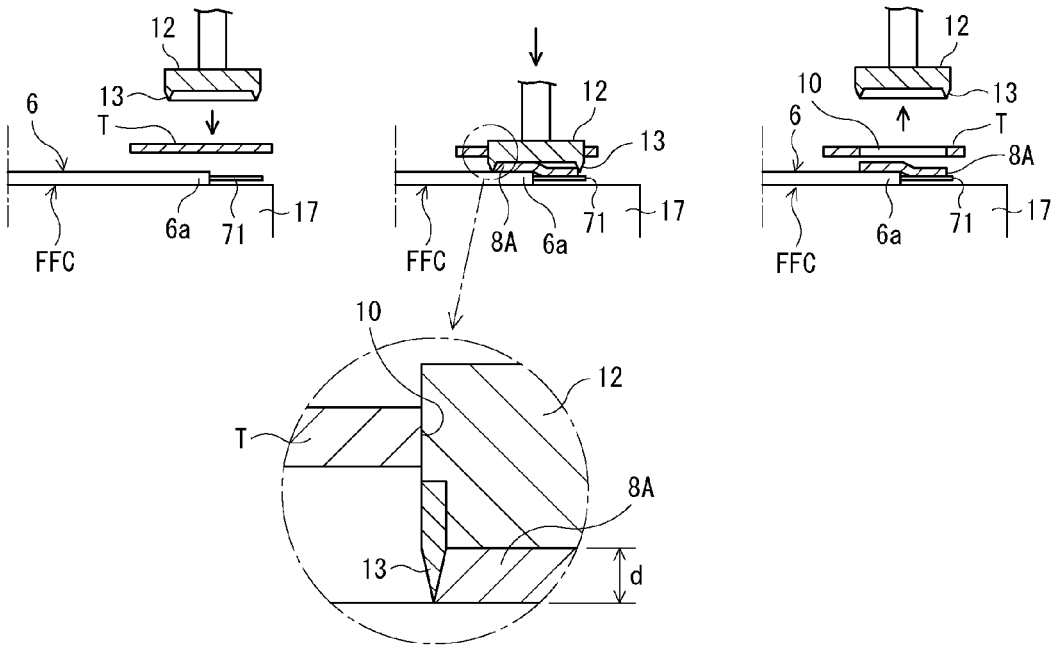

With regard to a procedure for assembling the flexible flat cable FFC, FIGS. 3(*a*) through 3(*d*) show a first step in which a first stamp 12 having approximately the same size as the central reinforcing plate 8A is arranged movably up and down, and cutting portions 13 are provided on the outer periphery of the first stamp 12, protruding from the first stamp 12 by an extent corresponding to the thickness "d" of the central reinforcing plate 8A. Also, FIGS. 4(*a*) through 4(*d*) show a second step in which a second stamp 14 having approximately the same size as the hollow square reinforcing plate 8B is arranged movably up and down, and cutting portions 15 are provided on the outer periphery of the second stamp 14, protruding from the second stamp 14 by an extent corresponding to the thickness "d" of the hollow square reinforcing plate 8B. Preferably, the stamps 12 and 14 as well as the cutting portions 13 and 15 are heated using a heater (not shown in the figures), where appropriate, for adhesive or fusion bonding or cutting.

The first step preferably includes: arranging a reinforcing tape T over an area extending from one end portion 71 of the conductive wire group 7 through the end portion 6*a* of the cover 6 in the cable FFC on a table 17 in a generally parallel-facing manner as shown in FIGS. 3(*a*) and 3(*b*); pressing the first stamp 12 having the cutting portions 13 against the reinforcing tape T to provide a through hole 10; pressing and fixing the central reinforcing plate 8A extracted by the first stamp 12 onto an area extending from the vicinity of the leading end of one end portion 71 of the conductive wire group 7 through one end portion of the cover 6 as shown in FIG. 3(*c*); and moving the first stamp 12 upward as shown in FIG. 3(*d*).

Figure 4A:
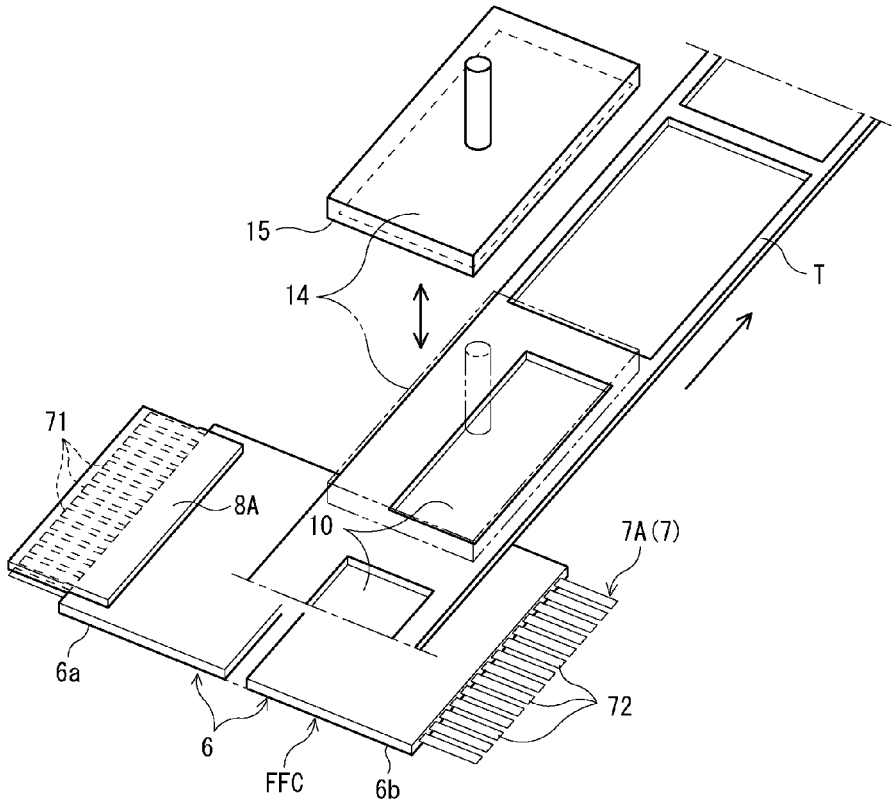
FIG. 4(*a*) is a perspective view of a second step in the assembling procedure, FIG. 4(*b*) is a profile cross-sectional view showing a previous stage of the second step, FIG. 4(*c*) is a profile cross-sectional view showing a middle stage of the second step, and FIG. 4(*d*) is a profile cross-sectional view showing a latter stage of the second step.
Figures 4B, 4C, 4D:
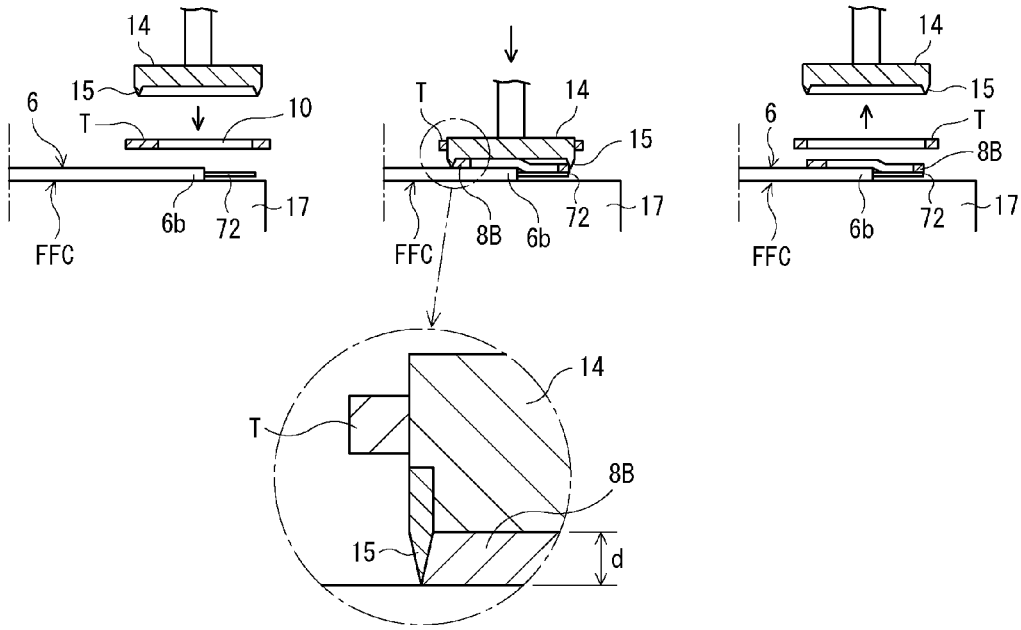

The second step preferably includes: arranging the reinforcing tape T with the through hole 10 provided therein over an area extending from the other end portion 72 of the conductive wire group 7 through the end portion 6*b* of the cover 6 in a generally parallel-facing manner as shown in FIGS. 4(*a*) and 4(*b*); pressing the second stamp 14 having the cutting portions 15 against the reinforcing tape T in such a manner as to surround the through hole 10; pressing and fixing the front edge portion 81 of the hollow square reinforcing plate 8B extracted by the pressing process against the leading end of the other end portion 72 of the conductive wire group 7 while pressing and fixing the rear edge portion 82 thereof against the end portion 6*b* of the cover 6; pressing and fixing both the left and right side edge portions 83 and 84 of the hollow square reinforcing plate 8B integrally conjoining the front and rear edge portions 81 and 82 of the hollow square reinforcing plate 8B onto an area extending from the both side edges of the corresponding end portion 72 of the conductive wire group 7 through the end portion 6*b* of the cover 6 as shown in FIG. 4(*c*); and moving the second stamp 14 upward as shown in FIG. 4(*d*).

In accordance with the arrangement above, the central reinforcing plate 8A is extracted from the reinforcing tape T and fixed to one end portion 71 of the conductive wire group 7 in the first step, and then the reinforcing tape T is reused after the central reinforcing plate 8A has been extracted, to extract the hollow square reinforcing plate 8B that is subsequently fixed to the other end portion 72 of the conductive wire group 7 in the second step. Accordingly, many flexible flat cables FFC can be assembled continuously and efficiently, and since the central reinforcing plate 8A and the hollow square reinforcing plate 8B are both extracted from the same reinforcing tape T (preferably, the same section of the reinforcing tape T), it is possible to reduce material cost significantly.

Figure 5A:
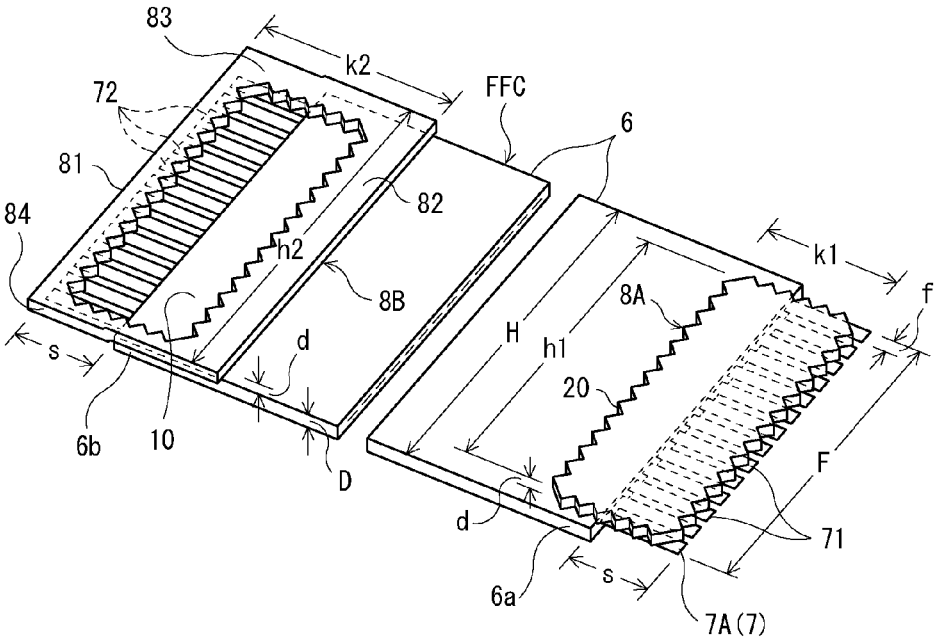
FIG. 5(*a*) is a perspective view of a flexible flat cable according to a second embodiment, FIG. 5(*b*) is a plan view thereof, and FIG. 5(*c*) is a profile view thereof in the direction of the arrow B-B.
Figure 5B:
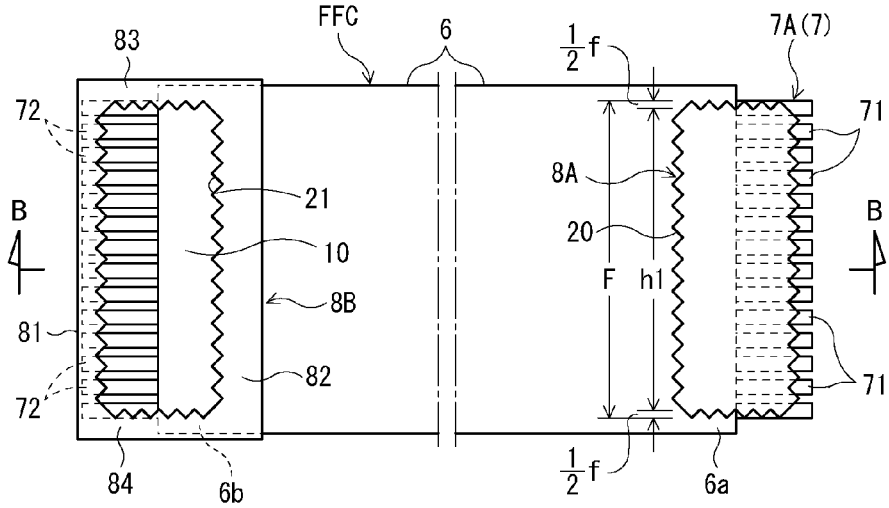
Figure 5C:
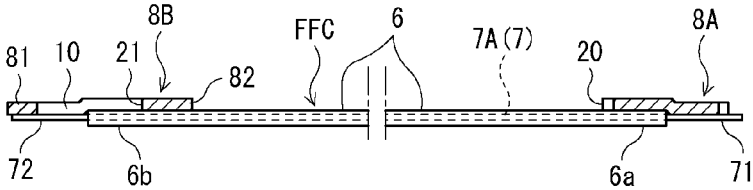
Figure 6:
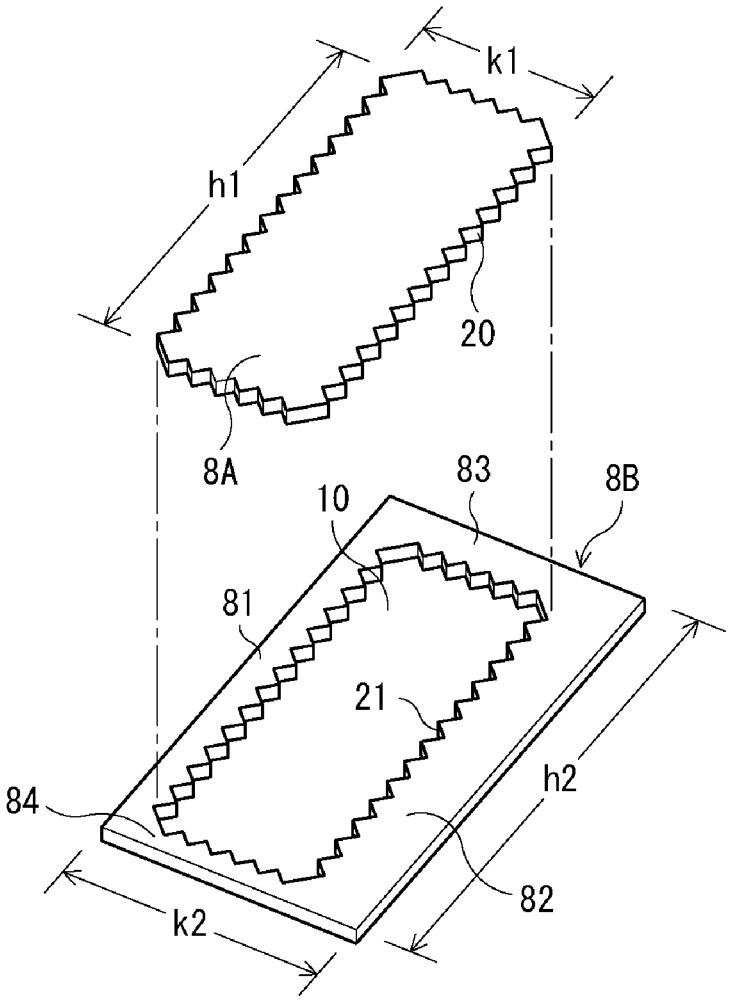
FIG. 6 is a disassembled perspective view of a reinforcing plate.

FIGS. 5(*a*), 5(*b*) and 6 show a flexible flat cable FFC according to a second embodiment, in which the outer peripheral edge 20 of the central reinforcing plate 8A and the inner peripheral edge 21 of the through hole 10 in the hollow square reinforcing plate 8B are both formed in a zigzag shape. In accordance with such an arrangement, it is possible to achieve similar effects as in the first embodiment, inter alia; and furthermore, it is possible to prevent fingers from slipping and to perform the insertion operation more reliably, because the zigzag-shaped outer peripheral edge 20 of the central reinforcing plate 8A and the zigzag-shaped inner peripheral edge 21 of the hollow square reinforcing plate 8B can be more securely grasped between the fingers when inserting the end portions 71 and 72 of the conductive wire group 7 into connectors 5.

Figure 7A:
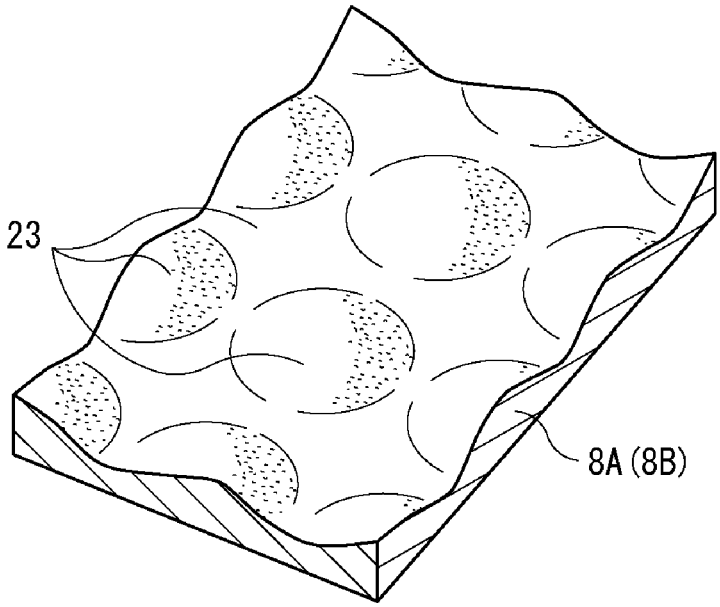
FIG. 7(*a*) is a perspective view of a section of a flexible flat cable according to a third embodiment, and FIG. 7(*b*) is a perspective view of a section of a flexible flat cable according to a fourth embodiment.
Figure 7B:
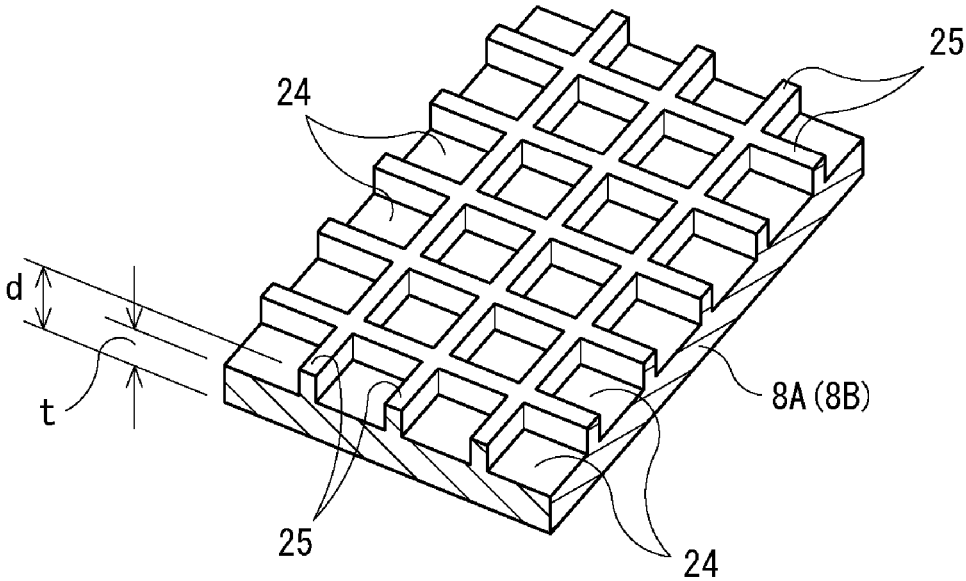

In the examples set forth above in relation to the first and second embodiments, the surfaces of the reinforcing plates 8A and 8B are formed in a flat and smooth manner; however, the embodiments are not necessarily restricted thereto. As one alternative example with respect to the third embodiment, as shown in FIG. 7(*a*), concavo-convex anti-slip portions 23 including many circular recessed portions and convex portions may be formed on the surface of the reinforcing plates 8A and 8B, for example. In accordance with this arrangement, because the concavo-convex anti-slip portions 23 can be securely held between the fingers when inserting the end portions 71 and 72 of the conductive wire group 7 into connectors 5, it is possible to prevent fingers from slipping and to perform the insertion operation more reliably.

Also, as shown in FIG. 7(*b*), with respect to an example of the fourth embodiment, many recessed portions 24 may be formed on the surfaces of the reinforcing plates 8A and 8B at predetermined spacing so that grid reinforcing frames 25 are left between the recessed portions 24. In accordance with this arrangement, since many recessed portions 24 are formed at predetermined spacing and correspondingly reduce the thickness "t" of the reinforcing plates 8A and 8B, it is possible to further reduce material cost. In addition, since the grid reinforcing frames 25 remain (preferably forming a lattice or grid-like pattern, as shown for example in FIG. 7(*b*)), the end portions 71 and 72 of the conductive wire group 7 can be reinforced reliably with no reduction in strength and the grid reinforcing frames 25 can further enhance the anti-slip effect. To give one possible example, the original thickness "d" of the reinforcing plates 8A and 8B may be 0.35 mm and the thickness "t" of the recessed portions 24 being formed may be 0.18 mm.

Although some of the features and embodiments above are described in reference to flexible flat cables FFC used in disk apparatuses (such as, e.g., DVD players and/or DVD recorders) as non-limiting examples, the present invention is not necessarily restricted thereto but also pertains to any appropriate flexible flat cables FFC such as used in various kinds of electronic devices or other applications. Furthermore, the invention is not restricted to the illustrative embodiments and aspects set forth by way of example above, but is instead defined by the claims set forth below and their equivalents.

What is claimed is:

1. A flexible flat cable, comprising:

a conductive wire group including a plurality of conductive wires arranged parallel to each other;

a cover including a synthetic resin and disposed on the conductive wire group, first and second end portions of said conductive wire group protruding outward from respective end edges of said cover, the first and second end portions of said conductive wire group being adapted to be inserted into connectors;

a hollow square reinforcing plate having a through hole disposed generally centrally in the hollow square reinforcing plate, the through hole formed by extracting a central reinforcing plate from said reinforcing plate, said central reinforcing plate being fixed to a vicinity of a leading end of the first end portion of said conductive wire group and to a first end portion of said cover, a front edge portion of said hollow square reinforcing plate being fixed to a leading end of the second end portion of said conductive wire group, a rear edge portion of the hollow square reinforcing plate being fixed to a second end portion of said cover, and both a left and a right side edge portions of the hollow square reinforcing plate integrally joining the front and rear edge portions of the hollow square reinforcing plate fixed to a respective left or right side edge of the second end portion of said conductive wire group and to the second end portion of said cover, wherein a plurality of concavo-convex anti-slip portions are formed on a surface of said central reinforcing plate and on a surface of said hollow square reinforcing plate.

2. A flexible flat cable, comprising:

a conductive wire group including a plurality of conductive wires arranged parallel to each other;

a cover including a synthetic resin and disposed on the conductive wire group, first and second end portions of said conductive wire group protruding outward from respective end edges of said cover, the first and second end portions of said conductive wire group being adapted to be inserted into connectors;

a hollow square reinforcing plate having a through hole disposed generally centrally in the hollow square reinforcing plate, the through hole formed by extracting a central reinforcing plate from said reinforcing plate, said central reinforcing plate being fixed to a vicinity of a leading end of the first end portion of said conductive wire group and to a first end portion of said cover, a front edge portion of said hollow square reinforcing plate being fixed to a leading end of the second end portion of said conductive wire group, a rear edge portion of the hollow square reinforcing plate being fixed to a second end portion of said cover, and both a left and a right side edge portions of the hollow square reinforcing plate integrally joining the front and rear edge portions of the hollow square reinforcing plate fixed to a respective left or right side edge of the second end portion of said conductive wire group and to the second end portion of said cover, wherein an outer peripheral edge of said central reinforcing plate and an inner peripheral edge of said through hole in said hollow square reinforcing plate are each formed in a zigzag shape, and a plurality of recessed portions are formed in a surface of said central reinforcing plate and in a surface of said hollow square reinforcing plate so that a plurality of grid reinforcing frames are disposed between said recessed portions.

3. A flexible flat cable, comprising:

a conductive wire group including a plurality of conductive wires arranged parallel to each other;

a cover including a synthetic resin and disposed on the conductive wire group, first and second end portions of said conductive wire group protruding outward from first and second end edges of said cover; and first and second synthetic resin reinforcing plates fixed to surfaces at first and second end portions of said cover and to surfaces at the first and second end portions of said conductive wire group, the first and second end portions of said conductive wire group fixed to said first and second reinforcing plates each being adapted to be inserted into connectors, wherein the first reinforcing plate is a hollow square reinforcing plate having a through hole disposed within the hollow square reinforcing plate and the second reinforcing plate is a central reinforcing plate extracted from said first reinforcing plate.

4. The flexible flat cable according to claim 3, wherein said central reinforcing plate is fixed to a vicinity of a leading end of the first end portion of said conductive wire group and to the first end portion of said cover, a front edge portion of said hollow square reinforcing plate is fixed to a leading end of the second end portion of said conductive wire group, a rear edge portion of the hollow square reinforcing plate is fixed to the second end portion of said cover, and both a left and a right side edge portions of the hollow square reinforcing plate integrally conjoin the front and rear edge portions of the hollow square reinforcing plate, respectively, and are respectively fixed to a left and a right side edges of the second end portion of said conductive wire group and also to the second end portion of said cover.

5. The flexible flat cable according to claim 3, wherein an outer peripheral edge of said central reinforcing plate and an inner peripheral edge of said through hole in said hollow square reinforcing plate are each formed in a zigzag shape.

6. The flexible flat cable according to claim 3, wherein a plurality of concavo-convex anti-slip portions are formed in a surface of said central reinforcing plate and in a surface of said hollow square reinforcing plate.

7. The flexible flat cable according to claim 3, wherein a plurality of recessed portions are formed in a surface of said central reinforcing plate and in a surface of said hollow square reinforcing plate, and grid reinforcing frames are disposed between said recessed portions.

* * * * *

UNITED STATES PATENT AND TRADEMARK OFFICE

CERTIFICATE OF CORRECTION

PATENT NO. : 7,312,398 B2
APPLICATION NO. : 11/534467
DATED : December 25, 2007
INVENTOR(S) : Masato Suekuni It is certified that error appears in the above-identified patent and that said Letters Patent is hereby corrected as shown below:

On the Title page, in the bibliographic data under the heading item ‘ (30) Foreign Application Priority Data’, delete the text:

“Sep. 26, 2005 (JP) . . . . . 2005-007863”

and, in substitution therefor, insert the following replacement text:

--Sep. 26, 2005 (JP) . . . . . 2005-007863U--.

Signed and Sealed this

Twentieth Day of May, 2008

JON W. DUDAS
*Director of the United States Patent and Trademark Office*